US009226375B2

(12) United States Patent
Smith

(10) Patent No.: US 9,226,375 B2
(45) Date of Patent: Dec. 29, 2015

(54) THEATRICAL EFFECTS CONTROLLER

(71) Applicant: James David Smith, Raleigh, NC (US)

(72) Inventor: James David Smith, Raleigh, NC (US)

(73) Assignee: Soundsculpture Incorporated, Raleigh, NC (US)

( * ) Notice: Subject to any disclaimer, the term of this patent is extended or adjusted under 35 U.S.C. 154(b) by 110 days.

(21) Appl. No.: 14/066,303

(22) Filed: Oct. 29, 2013

(65) Prior Publication Data

US 2015/0115829 A1 Apr. 30, 2015

(51) Int. Cl.
*H05B 37/02* (2006.01)

(52) U.S. Cl.
CPC ..... *H05B 37/029* (2013.01); *H05B 37/0272* (2013.01)

(58) Field of Classification Search
CPC ..... G09G 3/02; G09G 3/14; G09G 3/2044; G09G 3/2048
See application file for complete search history.

(56) References Cited

U.S. PATENT DOCUMENTS 4,980,806 A * 12/1990 Taylor ..... H05B 7/029 315/316
5,070,399 A * 12/1991 Martel ..... H04N 9/31 340/815.65
6,936,978 B2 * 8/2005 Morgan ..... F21K 9/13 315/291
7,139,617 B1 * 11/2006 Morgan ..... H05B 37/029 345/207
9,011,247 B2 * 4/2015 Gronkowski ..... G07F 17/3211 463/30
2004/0160199 A1 * 8/2004 Morgan ..... A01M 1/04 315/312
2005/0111231 A1 * 5/2005 Crodian ..... B60Q 1/1423 362/545
2006/0082331 A1 * 4/2006 Ashdown ..... H05B 33/0842 315/291
2009/0153352 A1 * 6/2009 Julio ..... H05B 33/0863 340/4.3
2010/0130812 A1 * 5/2010 Martel ..... A61M 21/02 600/27
2011/0115413 A1 * 5/2011 Erickson ..... H05B 37/029 315/312
2013/0278169 A1 * 10/2013 Reinoso ..... H05B 37/0272 315/294
2014/0184097 A1 * 7/2014 Luk ..... H05B 37/0254 315/297

OTHER PUBLICATIONS

City Theatrical, SHoW DMX Neo D2 Dimmer User's Manual, 2013, Rev 0.12, all pages.*

* cited by examiner

*Primary Examiner* — Jason M Crawford
*Assistant Examiner* — Kurtis R Bahr
(74) *Attorney, Agent, or Firm* — James A. Italia; Italia IP

(57) ABSTRACT

Provided is a system for controlling lighting effects. The system comprises a controller and one or more wireless dimmer devices with incorporated digital effects engine. The controller transmits wirelessly and effects parameters to the wireless dimmer devices. The dimmer devices receive the effects parameters, generate output effects parameters using the digital effects engine, and provide the output effects parameters to either dimmer output channels or DMX output channels. The digital effect engine comprises a low frequency oscillator and several random number generators. The random number generators may be used to modulate frequency of the low frequency oscillator and modulate a level of each dimmer output channel. The random number generators are configured to generate independent strings of pseudo-random numbers.

20 Claims, 7 Drawing Sheets

THEATRICAL EFFECTS CONTROLLER

CROSS REFERENCE TO RELATED APPLICATIONS

The present application claims the benefit of priority to U.S. Provisional Application No. 61/823,201, filed on May 14, 2013. The subject matter of aforementioned application is incorporated herein by reference for all purposes to the extent that such subject matter is not inconsistent herewith or limiting hereof.

TECHNICAL FIELD

This disclosure relates generally to devices and systems for creating lighting effects, and more specifically to wireless controlled devices and systems for creating lighting effects in theatrical and film sets, set pieces, props, and other entertainment and educational applications.

BACKGROUND

The devices for controlling lighting effects are widely used in entertainment business. Generally, a system for creating lighting effects comprises several dimmer devices governing intensities of light generating devices. The dimmer devices in turn are controlled by a central lighting console using industry-standard Digital MultipleX (DMX) protocol by means of standard DMX cables. There are also dimmer devices which are able to receive DMX signal via radio network.

Propsmasters are often called upon to create, for example, "dancing light and shadow" as might be cast by fire in a barrel, a blue-white shimmer of an arc-welder, or a TV screen facing away from the observer. Many of these effects can benefit from the use of random numbers to create visual variation. For example, a fire can change somewhat unpredictably as it reacts to changes in air currents.

The lighting designer and console programmer must painstakingly create the desired "looks", emulating randomness where needed. To create this random look requires multiple channels and they must appear unrelated to one another. This results in a more difficult programming task.

Creating these effects with a lighting console also consumes many control channels, since each individual dimmer should be connected to a light source, while individually programmed and controlled. For example, a small fire effect can be convincingly created using 4 control channels. But to create 6 such fire effects in different locations on the stage, all functioning at the same time but independent from one another, would require 24 control channels.

SUMMARY

Embodiments of the present disclosure may address limitations present in the systems for generating lighting effects described above.

In some embodiments a system for generating lighting effects may comprise one or more portable, battery-powered, radio-controlled wireless dimmers with a built-in digital effects engine, the wireless dimmers being small enough to be easily concealed in most theatrical and film sets, set pieces, and props. Several such wireless dimmer devices may be controlled by a single wireless controller.

By incorporating a programmable digital effects engine into a small, battery powered wireless dimmer, it is possible for propsmasters to create completely untethered props capable of producing the desired lighting effects with far less connecting cables or channels and programming effort.

This may be done by using DMX control channels to set effect parameters, rather than directly controlling lamp dimmer intensities. In various embodiments of the present disclosure, the actual parameters may vary, particularly to specialize in a particular type of effect.

BRIEF DESCRIPTION OF DRAWINGS

Embodiments are illustrated by way of example and not limitation in the figures of the accompanying drawings, in which like references indicate similar elements and in which.

DETAILED DESCRIPTION

The following detailed description includes references to the accompanying drawings, which form a part of the detailed description. The drawings show illustrations in accordance with example embodiments.

The systems, devices and methods described herein can allow for the controlling of lighting effects. The controlling technology described in the present disclosure may be practiced in theatrical and film sets, set pieces, props, and other entertainment and educational applications.

In some embodiments, the system for controlling lighting effects may comprise a controller device and a set of wireless dimmer devices. In certain embodiments, the dimmer device may comprise at least a receiver, a built-in digital effects engine, and several dimmer output channels. In some embodiments the digital effects engine may comprise a low frequency oscillator and several random number generators, one of the random number generator being associated with the low frequency oscillator to modulate its frequency, and other random number generators being associated with each dimmer output channel to modulate its output level. The random number generators may be configured to generate independent strings of pseudo-random numbers that may allow a user to independently modulate the levels of different dimmer output channels. By using the independent random number generators, several dimmer devices placed in different places on stage may produce non-synchronized lighting effects while being controlled with a single wireless controller.

Figure 1:
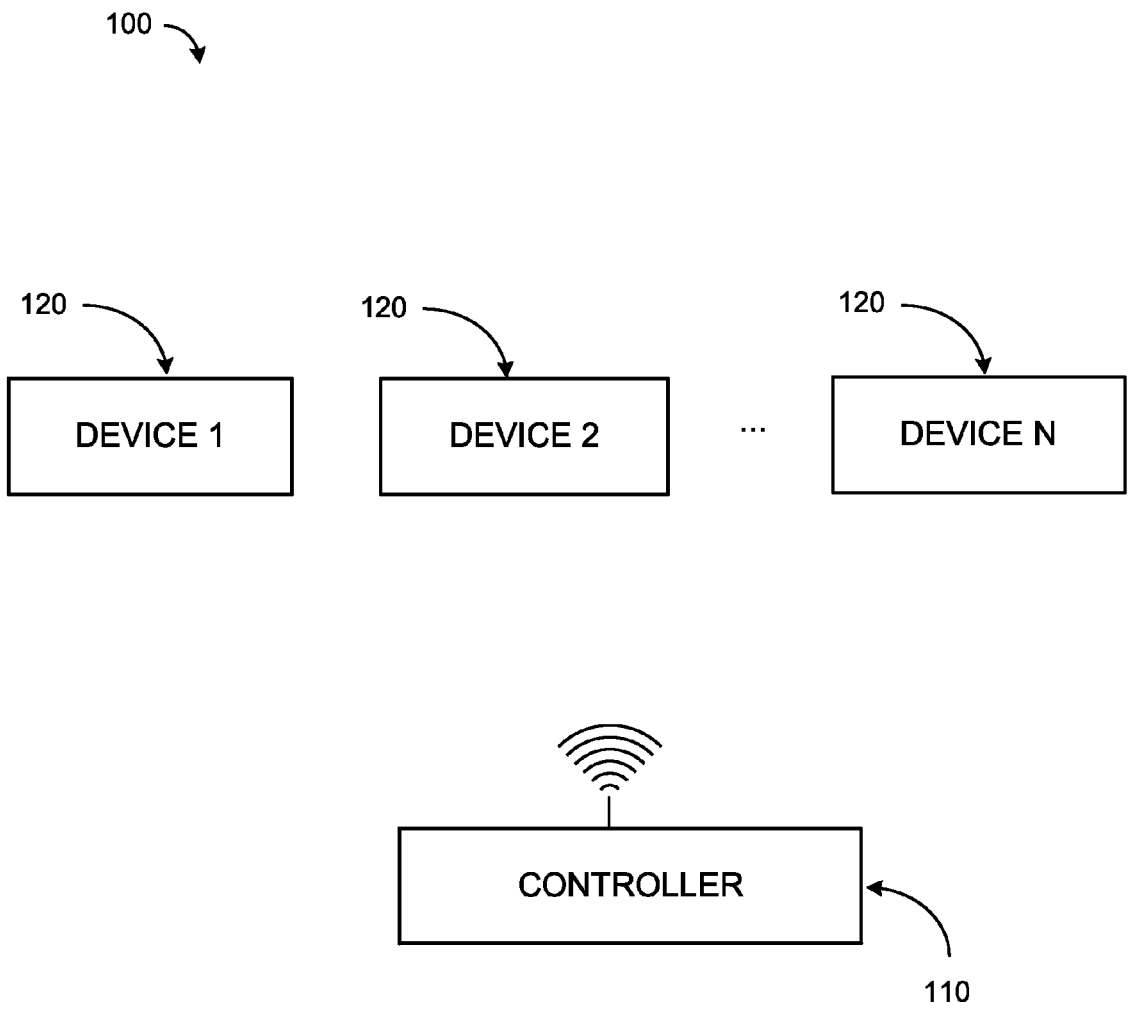
FIG. 1 shows an example of system for generating lighting effects according to an example embodiment.

FIG. 1 shows a system 100 for controlling lighting effects according to an example embodiment. The system 100 may comprise a controller unit 110 and one or more dimmer devices 120. The dimmer devices 120 may be placed on a theatrical or film stage, or another entertainment set and controlled by the controller unit 110 via a radio signal.

The controller unit may convert effect parameters presented in industry standard format, i.e. Digital MultipleX (DMX) format, to a proprietary wireless format and transmit the effect parameters to devices 120 by a radio signal. The proprietary format may use System IDs for privacy and may include error checking and other defenses against dropouts and interference.

Figure 2:
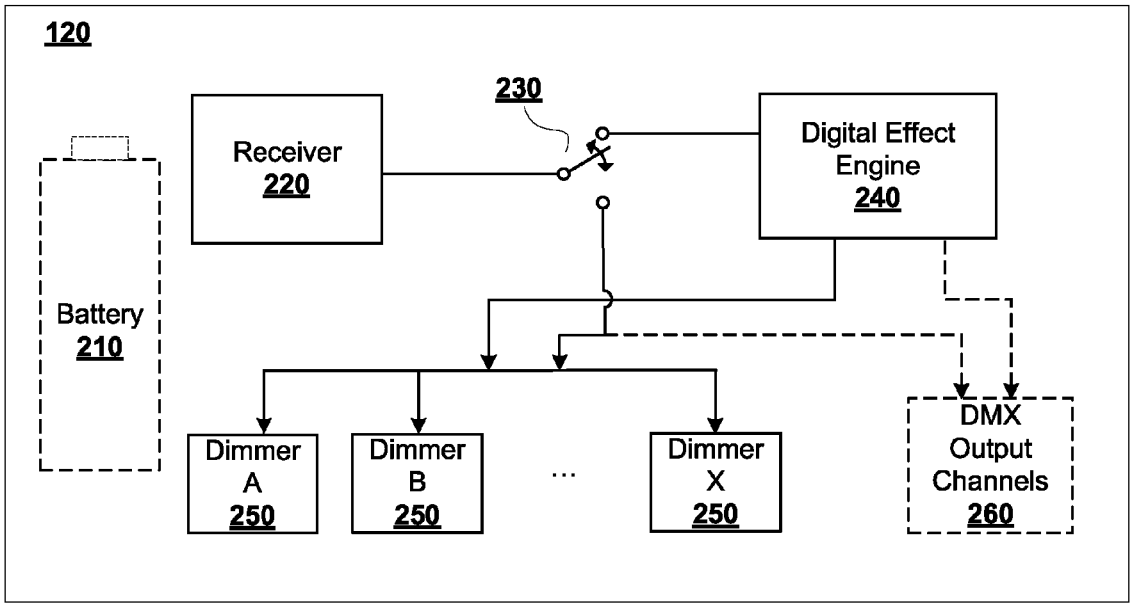
FIG. 2 depicts a dimmer device for controlling lighting effects according to an example embodiment.

FIG. 2 depicts a dimmer device 120 for controlling lighting effects according to an example embodiment. The dimmer device 120 may comprise at least a receiver unit 220, digital effects engine 240, and one or more dimmer output channels 250.

In some embodiments, the dimmer device 120 for controlling lighting effects may be powered by a battery 210, while in other embodiments the dimmer device 120 may be powered by a regular AC line (not shown in FIG. 2).

In some embodiments, the dimmer device 120 may comprise DMX output channels 260 configured to provide DMX signal to external dimmers by a DMX cable.

The receiver 220 may receive effects parameters in a proprietary format transmitted by the controller 110 of FIG. 1, convert the effects parameters to industry-standard DMX format, and pass the converted effects parameters to the digital effects engine 240.

The digital effects engine 240 may receive the effects parameters in DMX format from receiver 220. Based on the received effect parameters, the digital effects engine may generate output effects parameters in DMX format and pass the output effects parameters to dimmer output channels 250. In some embodiments, the output effects parameters may be also provided to DMX output channels 260.

In certain embodiments, the device 120 may further comprise a switch 230. The switch 230 may be configured to turn on and off the digital effect engine 240. When the digital effect engine is off, the receiver 220 may pass the effects parameters directly to dimmer output channels 250 or DMX output channels 260.

Figure 3:
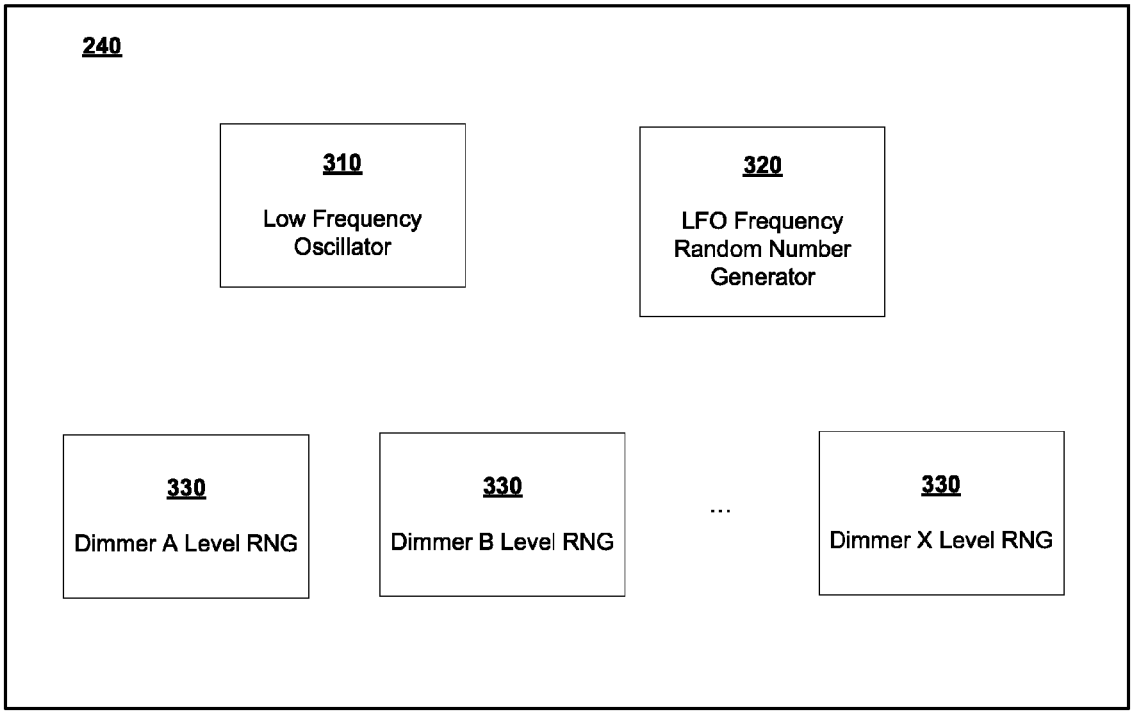
FIG. 3 depicts a scheme of a digital effects engine incorporated into a dimmer device for controlling lighting effects according to an example embodiment.

FIG. 3 depicts a scheme of digital effects engine 240 incorporated in a dimmer device 120 for controlling lighting effects according to an example embodiment. The digital effects engine 240 may comprise at least one Low Frequency Oscillator (LFO) 310, a random number generator 320 for modulating the frequency of the LFO 310, and separate random number generators 330 for modulating the level of each available dimmer output 250 of FIG. 2. In operation, the digital effects engine 240 may comprise additional or different components. Similarly, the digital effect engine 240 may comprise fewer components that perform functions similar or equivalent to those depicted in FIG. 2.

In some embodiments, the digital effects engine may comprise a processor and a memory (not shown in FIG. 2). The processor may use floating point operations, complex operations, and other operations. The processor may be configured to execute applications stored in memory to perform different function of the digital effects engine 240.

The LFO 310 may generate a triangle-wave output. In other embodiments, the digital effects engine may comprise multiple LFOs and additional random number generators. In certain embodiments, LFOs may provide additional waveshapes including programmable complex wave shapes configurable by the user.

The digital effects engine 240 may be provided by at least the following parameters:

1. A master fader to adjust the total light output of the digital effects engine, across all dimmer outputs.
2. A fundamental or base level for each available dimmer outputs in the effect.
3. Frequency of the Low Frequency Oscillator (LFO).
4. Depth of random number influence on the frequency of the LFO.
5. Inverted and non-inverted depth of LFO influence on the level of each available dimmer output.
6. Depth of random number influence on the level of each available dimmer outputs.

Based on the received effect parameters 1-6, the digital effects engine 240 may generate modified output effects parameters on the fly using low frequency oscillator 310 and random number generators 320 and 330. The output effect parameters may be further provided to internal dimmer output channels 250 or DMX output channels 260.

While running simultaneously, the random number generators 320 for modulating frequency of LFO 310 and each of the random number generators 330 for modulating level of dimmers 250 may be configured to generate different strings of pseudo-random numbers.

In some embodiments of the digital effects engine 240, an analog power-up-timer may be used to create an extremely short but truly random delay period when the digital effects engine powers up. The period of this timer may be used to seed a pseudo-random number generator. The probability of any two units using the same string of pseudo-random numbers is low. Thus, by providing a single depth control parameter (parameter 6 above) to the digital effects engine, the influence of multiple separate random number generators on each available dimmer may be controlled.

In certain embodiments, 2 channels may provide Digital effects engine parameters, that may be mapped to the 8 industry-standard DMX channels:

Master Fader (base DMX channel)
A base level (base+1)
B base level (base+2)
LFO triangle: depth to dimmer A, CENTER-OFF (base+3), non-inverted above center, inverted below center
LFO triangle: depth to dimmer B, CENTER-OFF (base+4), non-inverted above center, inverted below center
LFO frequency (base+5)
random: depth to LFO frequency (base+6)
random: depth to A, B (base+7)

In other certain embodiments, 4 channels may provide the digital effects engine parameters, that may be mapped to the 12 industry-standard DMX channels:

Master Fader (base DMX channel)
A base level (base+1)
B base level (base+2)
C base level (base+3)
D base level (base+4)
LFO triangle: depth to color A, CENTER-OFF (base+5)
LFO triangle: depth to color B, CENTER-OFF (base+6)
LFO triangle: depth to color C, CENTER-OFF (base+7)
LFO triangle: depth to color D, CENTER-OFF (base+8)
LFO frequency (base+9)
random: depth to LFO frequency (base+10)
random: depth to A, B, C, D (base+11)

Referring back to FIG. 1, while being governed with a single wireless controller 110 and starting simultaneously, the multiple devices 120 may generate non-synchronized theatrical effects since they are using random number generators configured to generate different strings of pseudo-random numbers. Different strings of pseudo-random numbers may result in multiple units appearing to a human observer not to be linked to each other. In some embodiments, an analog timing circuit may be used to seed the firmware pseudo-random number generators (all RNGs) in each device 120. Due to component tolerances, temperature differences, and so forth, multiple devices each may produce unique strings of random codes. The multiple unique strings of random numbers may produce the most realistic variation in, for example, dancing flame effects, or simulation of analog television screen noise.

In certain embodiments, a user may wish to cause predictable synchronized blinking or flashing. The devices may be equipped with firmware-based with high-accuracy crystal clocks. LFOs in multiple devices 120 may start together and appear to stay together for quite a long time.

In some embodiments, random effect may be followed by a synchronized effect, or a synchronized effect may be re-synced after a period of time. In certain embodiments, an LFO "freeze" process as described below in connection with FIG. 5 may be used to stop or start the synchronization.

Figure 4:
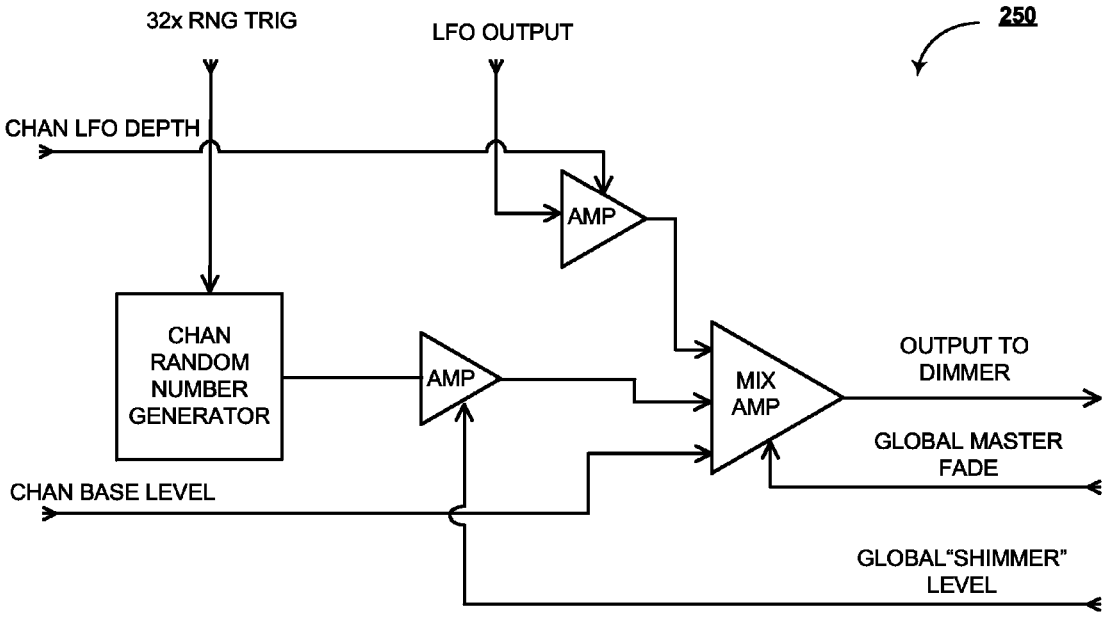
FIG. 4 is a schematic illustrating the operations of a dimmer channel according to an example embodiment.

FIG. 4 is a schematic illustrating the operations of dimmer channel 250 (also shown in FIG. 2) according to an example embodiment. In some embodiments, dimmer channel output may be controlled by a mix of at least three sources: a base channel level, a random number generator (RNG), and an LFO signal that can be scaled positively (uninverted) or negatively (inverted). In some embodiments, the RNG may be trigged. In certain embodiments, the level of the dimmer channel output may be additionally controlled by a global master fade channel and a global "shimmer" level channel. The signals received from the base channel level channel, RNG, LFO signal, global "shimmer" channel, and global master fade channel may be mixed using amplifiers as described in FIG. 4.

In some embodiments, each dimmer 250 of the device 120 for controlling lighting effects (shown in FIG. 2) may be coupled with a separate RNG to ensure that shimmer values are different for each channel. In some example embodiments, the same value of depth of the shimmer effect may be provided to all dimmers 250 within the device 120 of FIG. 2. In other embodiments, each dimmer channel may be provided with a unique shimmer depth control.

In certain embodiments, the LFO depth for each channel can be positive or negative and the LFO depth control off-center. This may add an uninverted LFO signal to the dimmer when the control is positive and may add inverted (i.e. negative) an LFO signal to the dimmer when the control is negative.

Figure 5:
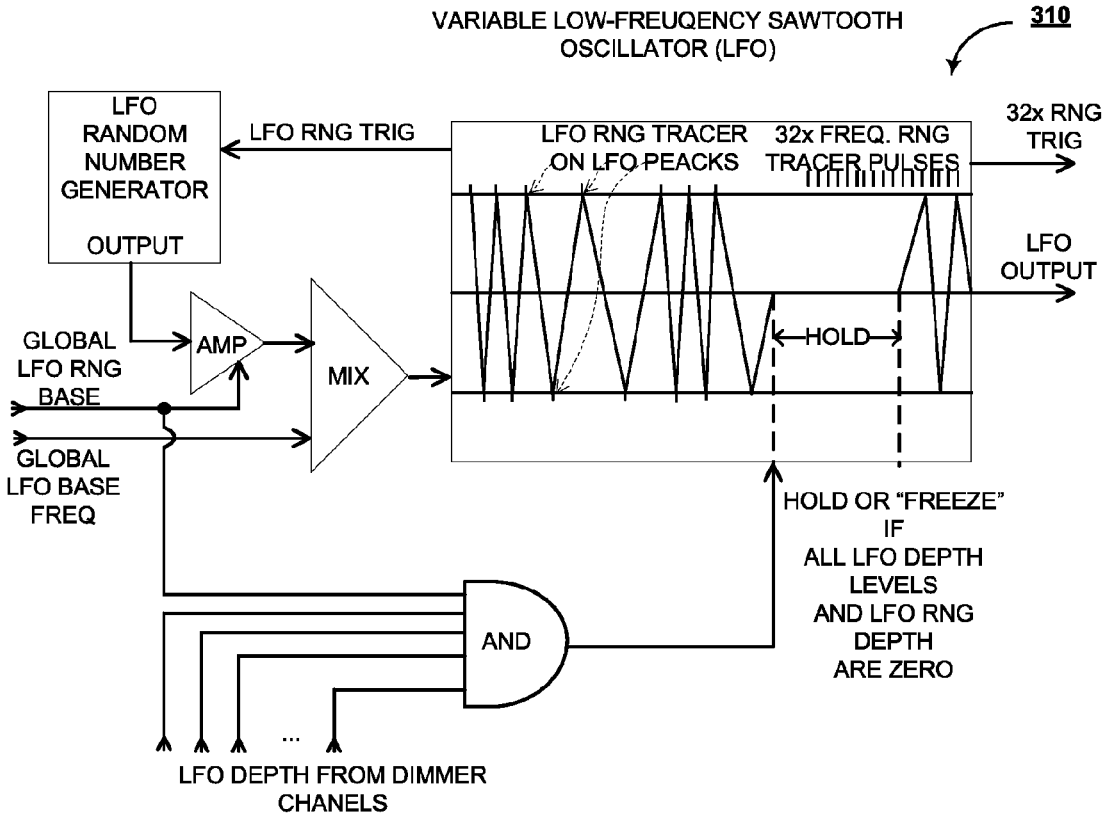
FIG. 5 is a schematic illustrating the operations of low-frequency oscillator according to an example embodiment

FIG. 5 is a schematic showing the operations of a LFO 310 (also shown in FIG. 3) according to an example embodiment. In some embodiments, the LFO may be configured to produce a sawtooth wave. A sawtooth slope (i.e. frequency) may be refreshed at each top and bottom peak. At that same point, the LFO Random Number Generator (RNG) may be triggered to produce a new value of random number. The next slope may be determined by a mix of the LFO base frequency control and the RNG value scaled by the depth control. In some embodiments, when the RNG depth control is at zero, the RNG may have no influence on the sawtooth slope and the LFO may produce a steady, quartz-locked output.

In further embodiments, the LFO may be configured to produce other wave shapes including true sine waves and square waves. The duty-cycle of square waves may be adjustable. The global controls for LFO waveshape and duty cycle may be available to the user.

In some embodiments, the LFO may be configured to produce waves of a custom defined shape. The custom wave shape may be defined as a series of points representing one quadrant of the wave. In certain embodiments, the number of points determining the resolution may be provided ahead of time. In some embodiments, 8 points per quadrant may be used to define the custom wave shape, resulting in 32 samples for the complete waveform. In other embodiments, a higher number of points to define wave form may be offered depending on the power of a processor.

In some embodiments, the LFO may be configured to "hold" or "freeze" oscillations. In certain embodiments, when the LFO output is not being used by any dimmer channel (e.g. sum of all depth from dimmer channel is zero), and LFO randomness is not being used, the LFO may stop oscillating and may be held at the center or zero level. The "freezing" may provide a means of resetting the LFO to a known state. When LFO depth of any channel is no longer zero, the LFO may be released to oscillate normally, starting with a positive slope up from the zero point.

Still referencing to FIG. 5, in some embodiments, the LFO may be configured to have two outputs: the LFO waveform and a series of trigger pulses. In certain embodiments, the trigger pulses may be generated 32 times during the period of one LFO frequency: 16 pulses for each rising slop and 16 pulses for each falling slope. The trigger pulses may be provided to dimmer output channels 250 (shown in FIG. 2 and FIG. 4) and for creating a shimmer effect. In further embodiments, the number of trigger pulses per wave period may be set by a user. In other embodiments, a separate LFO may be used to generate a shimmer effect.

Figure 6:
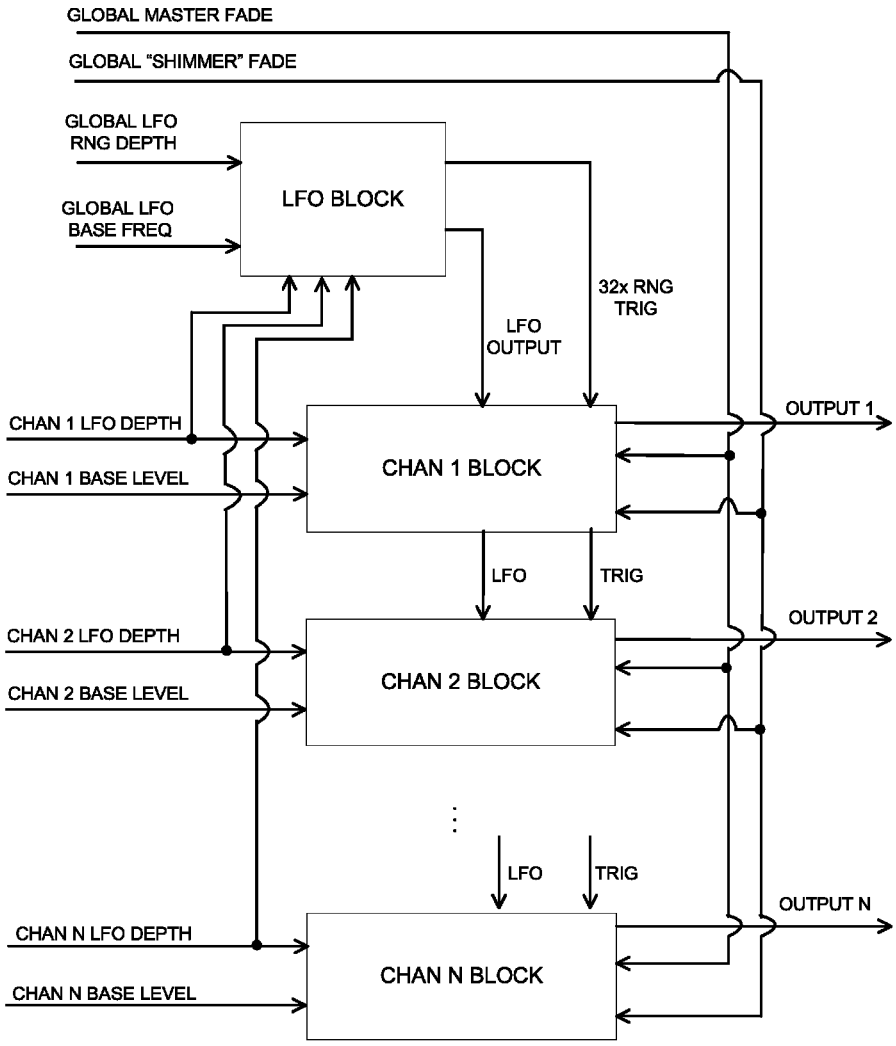
FIG. 6 is a schematic illustrating the operations of a device for controlling lighting effects according to an example embodiment.

FIG. 6 is a schematic illustrating the operations of digital effect engine according to an example embodiment. The digital effect engine of FIG. 6 may comprise at least an LFO block and N dimmer output channels blocks. The operations of an LFO block were described in FIG. 5, while operations of a dimmer output channel were described in FIG. 4. Similar to what is shown in FIG. 6, the LFO block may be controlled by a global LFO RNG base channel, a global LFO base frequency channel, and also by a sum of LFO depth channels provided to each individual dimmer output blocks. Each of the dimmer output blocks may be controlled by a global master fade channel and a global shimmer channel and may receive output wave and trigger pulses from the LFO. The dimmer output may process the received signal to set up a level for the corresponding dimmer.

Figure 7:
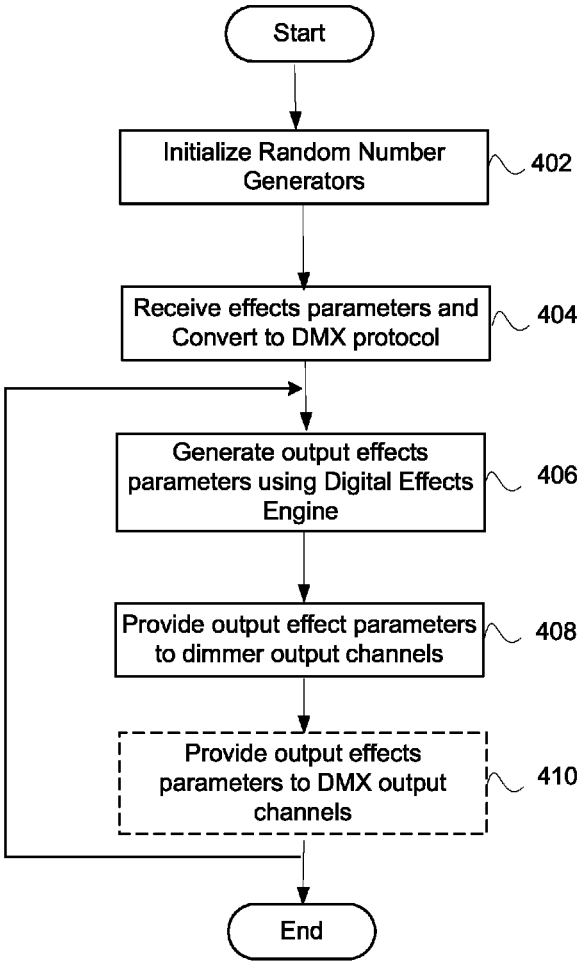
FIG. 7 is a flow chart diagram showing a method for controlling lighting effects using a dimmer device for controlling lighting effects according to an example embodiment.

FIG. 7 is a flow chart diagram illustrating a method 700 for controlling lighting effects using dimmer devices 110 according to an example embodiment. The method 700 of FIG. 7 may also include additional or fewer steps than those illustrated.

In step 702, random number generators 320 and 330 of the digital effects engine 240 may be initialized with different seeds to generate different strings of pseudo-random numbers.

In step 704, effects parameters may be received by receiver 220 from controller 110 via a radio signal. The effect parameters may be further converted from a proprietary format to an industry-standard DMX format and passed to the digital effects engine 240.

In step 706, the digital effects engine 240 may generate output effects parameters in the DMX format based on received effects parameters and using a LFO 310 and random numbers generators 320 and 330.

In step 708, output effects parameters generated by digital effects engine 240 may be provided to dimmer output channels 250 to control external light sources.

In step 710, output effects parameters generated by digital effects engine 240 may be optionally provided to DMX output channels to feed external dimmers.

Thus, systems, methods for wireless dimmer devices with the incorporated digital effects engine for controlling lighting effects have been disclosed.

The invention claimed is:

1. A wireless dimmer device for controlling lighting effects, the dimmer device comprising:
a receiver;
one or more dimmer output channels;
Digital MultipleX (DMX) output channels; and
a digital effects engine, the digital effects engine comprising:
one or more low frequency oscillators;
random number generators associated with each low frequency oscillator; and
random number generators associated with each dimmer output channel.

2. The device of claim 1, further comprising a battery to power the digital effects engine.

3. The device of claim 1, wherein the digital effects engine is powered by an alternating current line voltage.

4. The device of claim 1, further comprising a switch, the switch being configured to turn the digital effect engine on and off.

5. The device of claim 1, wherein the random number generators associated with low frequency oscillators and the dimmer output channels are configured to generate independent strings of random numbers.

6. The device of claim 1, wherein the receiver is configured to:
receive effects parameters in a proprietary format; and
convert received effects parameters to Digital MultipleX (DMX) format.

7. The device of claim 6, wherein the receiver is further configured to provide the effects parameters to the dimmer output channel.

8. The device of claim 6, wherein the receiver is further configured to provide the effects parameters to the digital effect engine.

9. The device of claim 8, wherein the random number generator associated with the low frequency oscillator is configured to modulate a frequency of the low frequency oscillator.

10. The device of claim 8, wherein the random number generator associated with the dimmer output level is configured to modulate a level of the dimmer output channel.

11. The device of claim 8, wherein the digital effects engine is configured to:
receive effects parameters from the receiver;
generate output effects parameters; and
provide the output effects parameters to the dimmer output channels.

12. The device of claim 8, wherein the digital effect engine is configured to:
receive effects parameters from the receiver;
generate output effects parameters; and
provide the output effects parameters in DMX format to the DMX output channels.

13. A system for controlling lighting effects, the system comprising:
a controller;
one or more dimmer device for controlling effects, the dimmer device comprising:
a receiver;
one or more dimmer output channels;
a Digital MultipleX (DMX) output channels; and
a digital effects engine, the digital effects engine comprising:
one or more low frequency oscillators;
random number generators associated with each low frequency oscillator; and
random number generators associated with each dimmer output channels.

14. The system of claim 13, wherein the controller is configured to:
convert effects parameters from Digital Multiplex format to a proprietary format; and
transmit wirelessly the effects parameters in the proprietary format.

15. The system of claim 13, wherein the receiver of the dimmer device for controlling effects is configured to:
receive effects parameters in a proprietary format;
convert the effects parameters from the proprietary format to a Digital MultipleX format; and
provide the effects parameters in Digital MultipleX format to the digital effects engine.

16. The system of claim 13, wherein the random number generators of the dimmer devices for controlling effects are configured to generate independent strings of random numbers.

17. The system of claim 13, wherein the digital effects engine of the device for controlling effects is configured to:
receive effect parameters from the receiver;
generate output effect parameters; and
provide the output effects parameters to the dimmer output channels.

18. The system of claim 13, wherein the digital effects engine of the device for controlling effects is configured to:
receive effect parameters from the receiver;
generate output effects parameters; and
provide the output effects parameters in DMX format to the DMX output channels.

19. A method for controlling lighting effects, the method comprising
receiving effects parameters in a proprietary format;
converting the effects parameters to industry-standard DMX format;
providing the effect parameters to a digital effects engine, the digital effects engine comprising:
one or more low frequency oscillators; and
two or more random number generators;
generating output effects parameters, based on the effect parameters and by utilizing the low frequency oscillator and the random number generators of the digital effects engine;
providing output effects parameters to dimmer output channels; and
providing output effects parameters to DMX output channels.

20. The method of claim 19, wherein the random number generators are configured to generate independent strings of pseudo-random numbers.

* * * * *